US009327487B2

(12) United States Patent
Liu

(10) Patent No.: US 9,327,487 B2
(45) Date of Patent: May 3, 2016

(54) VARIABLE LITHOGRAPHIC PRINTING PROCESS

(75) Inventor: Chu-heng Liu, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 755 days.

(21) Appl. No.: 13/601,876

(22) Filed: Aug. 31, 2012

(65) Prior Publication Data

US 2014/0060364 A1 Mar. 6, 2014

(51) Int. Cl.
*B41C 1/10* (2006.01)
*B41M 1/06* (2006.01)

(52) U.S. Cl.
CPC ..... *B41C 1/1008* (2013.01); *B41C 1/10* (2013.01); *B41M 1/06* (2013.01); *B41C 2210/02* (2013.01)

(58) Field of Classification Search
None
See application file for complete search history.

(56) References Cited

U.S. PATENT DOCUMENTS

| | | | | |
|---|---|---|---|---|
| 3,741,118 | A | 6/1973 | Carley | |
| 3,800,699 | A | 4/1974 | Carley | |
| 3,877,372 | A | 4/1975 | Leeds | |
| 4,627,349 | A | 12/1986 | Claussen | |
| 4,887,528 | A | 12/1989 | Ruge et al. | |
| 5,067,404 | A | 11/1991 | Frunder et al. | |
| 5,701,815 | A | 12/1997 | Bocko et al. | |
| 5,855,173 | A | 1/1999 | Chatterjee et al. | |
| 6,124,073 | A * | 9/2000 | Rompuy | B41C 1/1041 430/270.1 |
| 6,125,756 | A | 10/2000 | Nüssel et al. | |
| 6,146,798 | A | 11/2000 | Bringans et al. | |
| 6,318,264 | B1 | 11/2001 | D'Heureuse et al. | |
| 6,725,777 | B2 | 4/2004 | Katano | |
| 6,841,366 | B1 | 1/2005 | Bower et al. | |
| 7,020,355 | B2 | 3/2006 | Lahann et al. | |
| 7,061,513 | B2 | 6/2006 | Katano et al. | |
| 7,100,503 | B2 | 9/2006 | Wiedemer et al. | |
| 7,191,705 | B2 | 3/2007 | Berg et al. | |
| 8,347,787 | B1 | 1/2013 | Stowe et al. | |
| 2003/0167950 | A1 | 9/2003 | Mori | |
| 2004/0011234 | A1 | 1/2004 | Figov et al. | |
| 2005/0178281 | A1 * | 8/2005 | Berg | B41C 1/10 101/463.1 |
| 2005/0258136 | A1 | 11/2005 | Kawanishi et al. | |
| 2006/0081139 | A1 * | 4/2006 | Bolza-Schunemann | 101/148 |
| 2006/0152566 | A1 | 7/2006 | Taniuchi et al. | |
| 2007/0199457 | A1 | 8/2007 | Cyman, Jr. et al. | |
| 2007/0199458 | A1 | 8/2007 | Cyman, Jr. et al. | |
| 2007/0199459 | A1 | 8/2007 | Cyman, Jr. et al. | |

(Continued)

FOREIGN PATENT DOCUMENTS

| | | | |
|---|---|---|---|
| DE | 101 60 734 | A1 | 7/2002 |
| DE | 103 60 108 | A1 | 10/2004 |

(Continued)

OTHER PUBLICATIONS

European Search Report in corresponding related application EP 11 187 196.8 dated Mar. 30, 2012.
European Search Report in corresponding related application EP 11 187 195.0 dated Mar. 28, 2012.

(Continued)

*Primary Examiner* — Blake A Tankersley
*Assistant Examiner* — Michael Robinson
(74) *Attorney, Agent, or Firm* — Ronald E. Prass, Jr.; Prass LLP

(57) ABSTRACT

A variable lithographic printing process includes absorbing a release agent into an imaging member; forming a later image by evaporating the release agent from selective locations on an imaging member surface; developing the latent image; and transferring the developed image to a receiving substrate. The release agent diffuses through the imaging member surface.

12 Claims, 4 Drawing Sheets

(56) References Cited

U.S. PATENT DOCUMENTS

| | | | | |
|---|---|---|---|---|
| 2007/0199460 | A1 | 8/2007 | Cyman, Jr. et al. | |
| 2007/0199461 | A1 | 8/2007 | Cyman, Jr. et al. | |
| 2007/0199462 | A1 | 8/2007 | Cyman, Jr. et al. | |
| 2008/0011177 | A1 | 1/2008 | Muraoka | |
| 2008/0032072 | A1 | 2/2008 | Taniuchi et al. | |
| 2008/0223240 | A1 | 9/2008 | Drury et al. | |
| 2009/0056578 | A1* | 3/2009 | De Joseph | B41C 1/1066 101/451 |
| 2010/0031838 | A1 | 2/2010 | Lewis et al. | |
| 2012/0103212 | A1* | 5/2012 | Stowe et al. | 101/147 |
| 2012/0103213 | A1 | 5/2012 | Stowe et al. | |
| 2012/0103214 | A1 | 5/2012 | Stowe et al. | |
| 2012/0103217 | A1 | 5/2012 | Stowe et al. | |
| 2012/0103218 | A1 | 5/2012 | Stowe et al. | |
| 2012/0103219 | A1 | 5/2012 | Stowe et al. | |
| 2012/0103221 | A1 | 5/2012 | Stowe et al. | |
| 2012/0274914 | A1 | 11/2012 | Stowe et al. | |
| 2013/0032050 | A1 | 2/2013 | Pattekar et al. | |
| 2013/0033686 | A1 | 2/2013 | Stowe et al. | |
| 2013/0033687 | A1 | 2/2013 | Stowe et al. | |
| 2013/0033688 | A1 | 2/2013 | Stowe et al. | |

FOREIGN PATENT DOCUMENTS

| | | | |
|---|---|---|---|
| DE | 10 2006 050744 | A1 | 4/2008 |
| DE | 10 2008 062741 | A1 | 7/2010 |
| EP | 1 935 640 | A2 | 6/2008 |
| EP | 1 938 987 | A2 | 7/2008 |
| EP | 1 964 678 | A2 | 9/2008 |
| JP | 06-082213 | B * | 12/1987 |
| WO | 20061133024 | A2 | 12/2006 |
| WO | 20091025821 | A1 | 2/2009 |

OTHER PUBLICATIONS

European Search Report in corresponding related application EP 11 187 193.5 dated Feb. 29, 2012.
European Search Report in corresponding related application EP 11 187 192.7 dated Feb. 28, 2012.
European Search Report in corresponding related application EP 11 187 191.9 dated Mar. 1, 2012.
European Search Report in corresponding related application EP 11 187 190.1 dated Mar. 12, 2012.
European Search Report in corresponding related application EP 11 187 189.3 dated Feb. 28, 2012.
Shen et al., "A new understanding on the mechanism of fountain solution in the prevention of ink transfer to the non-image area in conventional offset lithography", J. Adhesion Sci. Technol., vol. 18, No. 15-16, pp. 1861-1887 (2004).
Katano et al., "The New Printing System Using the Materials of Reversible Change of Wettability", International Congress of Imaging Science 2002, Tokyo, pp. 297 et seq. (2002).
Biegelsen, U.S. Appl. No. 13/366,947, filed Feb. 6, 2012.
Liu et al., U.S. Appl. No. 13/426,209, filed Mar. 21, 2012.
Liu et al., U.S. Appl. No. 13/426,262, filed Mar. 21, 2012.
Lestrange et al., U.S. Appl. No. 13/601,803, filed Aug. 31, 2012.
Hsieh, U.S. Appl. No. 13/601,817, filed Aug. 31, 2012.
Hsieh et al., U.S. Appl. No. 13/601,840, filed Aug. 31, 2012.
Kelly et al., U.S. Appl. No. 13/601,854, filed Aug. 31, 2012.
Kanungo et al., U.S. Appl. No. 13/601,892, filed Aug. 31, 2012.
Moorlag et al., U.S. Appl. No. 13/601,905, filed Aug. 31, 2012.
Gervasi et al., U.S. Appl. No. 13/601,920, filed Aug. 31, 2012.
Gervasi et al., U.S. Appl. No. 13/601,938, filed Aug. 31, 2012.
Gervasi et al., U.S. Appl. No. 13/601,956, filed Aug. 31, 2012.
Kanungo et al., U.S. Appl. No. 13/601,962, filed Aug. 31, 2012.

* cited by examiner

VARIABLE LITHOGRAPHIC PRINTING PROCESS

FIELD OF DISCLOSURE

The present disclosure is related to imaging members as described herein. The imaging members are suitable for use in various marking and printing methods and systems, such as offset printing. Methods of making and using such imaging members are also disclosed.

BACKGROUND

Offset lithography is a common method of printing today. (For the purposes hereof, the terms "printing" and "marking" are interchangeable.) In a typical lithographic process a printing plate, which may be a flat plate, the surface of a cylinder, or belt, etc., is formed to have "image regions" formed of a hydrophobic/oleophilic material, and "non-image regions" formed of a hydrophilic/oleophobic material. The image regions correspond to the areas on the final print (i.e., the target substrate) that are occupied by a printing or marking material such as ink, whereas the non-image regions correspond to the areas on the final print that are not occupied by said marking material. The hydrophilic regions accept and are readily wetted by a water-based fluid, commonly referred to as a dampening fluid or fountain solution or release agent (typically consisting of water and a small amount of alcohol as well as other additives and/or surfactants to reduce surface tension). The hydrophobic regions repel release agent and accept ink, whereas the release agent formed over the hydrophilic regions forms a fluid "release layer" for rejecting ink. The hydrophilic regions of the printing plate thus correspond to unprinted areas, or "non-image areas", of the final print.

The ink may be transferred directly to a target substrate, such as paper, or may be applied to an intermediate surface, such as an offset (or blanket) cylinder in an offset printing system. The offset cylinder is covered with a conformable coating or sleeve with a surface that can conform to the texture of the target substrate, which may have surface peak-to-valley depth somewhat greater than the surface peak-to-valley depth of the imaging plate. Also, the surface roughness of the offset blanket cylinder helps to deliver a more uniform layer of printing material to the target substrate free of defects such as mottle. Sufficient pressure is used to transfer the image from the offset cylinder to the target substrate. Pinching the target substrate between the offset cylinder and an impression cylinder provides this pressure.

Typical lithographic and offset printing techniques utilize plates which are permanently patterned, and are therefore useful only when printing a large number of copies of the same image (i.e. long print runs), such as magazines, newspapers, and the like. However, they do not permit creating and printing a new pattern from one page to the next without removing and replacing the print cylinder and/or the imaging plate (i.e., the technique cannot accommodate true high speed variable data printing wherein the image changes from impression to impression, for example, as in the case of digital printing systems). Furthermore, the cost of the permanently patterned imaging plates or cylinders is amortized over the number of copies. The cost per printed copy is therefore higher for shorter print runs of the same image than for longer print runs of the same image, as opposed to prints from digital printing systems.

Accordingly, a lithographic technique, referred to as variable data lithography, has been developed which uses a non-patterned reimageable surface that is initially uniformly coated with a release agent layer. Regions of the release agent are removed by exposure to a focused radiation source (e.g., a laser light source) to form pockets. A temporary pattern in the release agent is thereby formed over the non-patterned reimageable surface. Ink applied thereover is retained in the pockets formed by the removal of the release agent. The inked surface is then brought into contact with a substrate, and the ink transfers from the pockets in the release agent layer to the substrate. The release agent may then be removed, a new uniform layer of release agent applied to the reimageable surface, and the process repeated.

In typical variable data lithography, the release agent (i.e. dampening fluid, fountain solution) is configured to rest on top of the reimageable surface. The edges and/or corners of the pockets that are formed by the removal of release agent tend to be reshaped by the fluid that remains on the surface, because the surface tension of the fluid causes creeping of fluid back into the pockets. As a result, image resolution and image fidelity are reduced.

It is desirable to identify alternate materials and processes that are suitable for use for imaging members in variable data lithography with enhanced resolution and fidelity.

SUMMARY

The present disclosure relates to imaging members for digital offset printing applications. The imaging members are capable of absorbing a release agent.

Disclosed in various embodiments are processes for variable lithographic printing, comprising: absorbing a release agent into an imaging member comprising an imaging member surface; forming a latent image by evaporating the release agent from selective locations at the imaging member surface to form hydrophobic non-image areas and hydrophilic image areas; developing the latent image by applying an ink composition to the hydrophilic image areas to form a developed image; and transferring the developed image to a receiving substrate.

The absorbed release agent generally diffuses to the imaging member surface to enhance the transferring.

The release agent may be a volatile silicone liquid, such as octamethylcyclotetrasiloxane (D4), decamethylcyclopentasiloxane (D5), hexamethyldisiloxane (OS10), or octamethyltrisiloxane (OS20).

The evaporation may be performed by laser heating, flash heating, or contact heating.

The imaging member may be a foam or a sponge. The foam or sponge may comprise an elastomeric material and a radiation-absorbing filler dispersed therein. The radiation absorbing filler can be carbon black. The elastomeric material can comprise a silicone rubber.

The receiving substrate may be moving at a rate of greater than about 1 meter per second, or greater than about 2 meters per second when the latent image is transferred.

Also disclosed are processes for variable lithographic printing, comprising: absorbing a silicone liquid release agent into an imaging member comprising a porous imaging member surface; forming a latent image by evaporating the release agent from selective locations on the imaging member surface to form hydrophobic non-image areas and hydrophilic image areas; developing the latent image by applying an ink composition to the hydrophilic image areas; and transferring the developed latent image to a receiving substrate; wherein the absorbed release agent diffuses to the imaging member surface to enhance the transferring.

Also disclosed is an imaging member comprising: a substrate; and a surface layer disposed on the substrate; wherein the surface layer is porous.

Apparatuses for variable lithographic printing comprising such imaging members are also disclosed.

These and other non-limiting aspects and/or objects of the disclosure are more particularly described below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
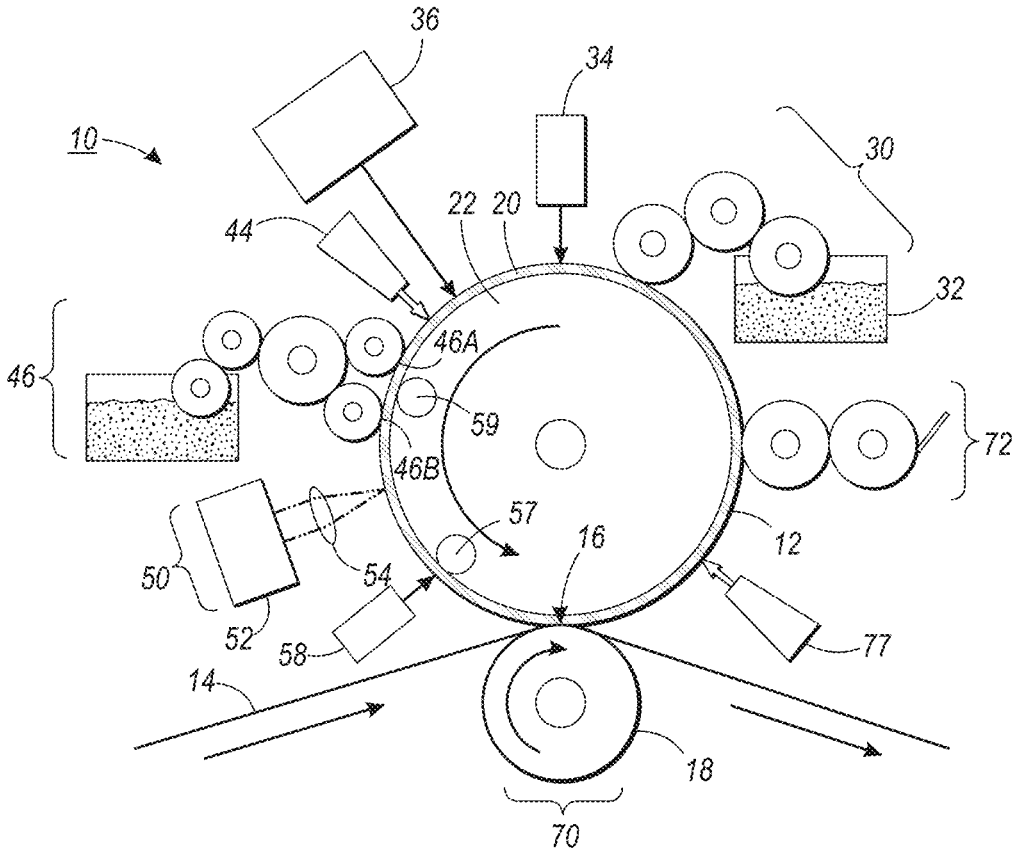
FIG. 1 illustrates a variable lithographic printing apparatus which may be used to perform the processes of the present disclosure.

A more complete understanding of the processes and apparatuses disclosed herein can be obtained by reference to the accompanying drawings. These figures are merely schematic representations based on convenience and the ease of demonstrating the existing art and/or the present development, and are, therefore, not intended to indicate relative size and dimensions of the assemblies or components thereof.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The term "room temperature" refers to 25° C.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

FIG. 1 illustrates a system for variable lithography in which the imaging members of the present disclosure may be used. The system 10 comprises an imaging member 12. The imaging member comprises a substrate 22 and a reimageable surface layer 20. The surface layer is the outermost layer of the imaging member, i.e. the layer of the imaging member furthest from the substrate. As shown here, the substrate 22 is in the shape of a cylinder; however, the substrate may also be in a belt form, etc. Note that the surface layer is usually a different material compared to the substrate, as they serve different functions.

In the depicted embodiment the imaging member 12 rotates counterclockwise and starts with a clean surface. Disposed at a first location is a release agent subsystem 30, which provides release agent 32 to the surface layer 20 of the imaging member 12. The release agent 32 is absorbed into the imaging member 12.

A sensor 34, such as an in-situ non-contact laser gloss sensor or laser contrast sensor, may be used to confirm the uniformity of the release agent layer. Such a sensor can be used to automate the release agent subsystem 30.

At optical patterning subsystem 36, the release agent layer is exposed to an energy source (e.g. a laser) that selectively applies energy to portions of the layer to image-wise evaporate the release agent and create a latent "negative" of the ink image that is desired to be printed on the receiving substrate. Image areas are created where ink is desired, and non-image areas are created where the release agent remains. An optional air knife 44 is also shown here to control airflow over the surface layer 20 for the purpose of maintaining clean dry air supply, a controlled air temperature, and reducing dust contamination prior to inking. Next, an ink composition is applied to the imaging member using inker subsystem 46. Inker subsystem 46 may consist of a "keyless" system using an anilox roller to meter an offset ink composition onto one or more forming rollers 46A, 46B. The ink coposition is applied to the image areas to form an ink image.

A rheology control subsystem 50 partially cures or tacks the ink image. This curing source may be, for example, an ultraviolet light emitting diode (UV-LED) 52, which can be focused as desired using optics 54. Another way of increasing the cohesion and viscosity employs cooling of the ink composition. This could be done, for example, by blowing cool air over the reimageable surface from jet 58 after the ink composition has been applied but before the ink composition is transferred to the final substrate. Alternatively, a heating element 59 could be used near the inker subsystem 46 to maintain a first temperature and a cooling element 57 could be used to maintain a cooler second temperature near the nip 16.

The ink image is then transferred to the target or receiving substrate 14 at transfer subsystem 70. This is accomplished by passing a recording medium or receiving substrate 14, such as paper, through the nip 16 between the impression roller 18 and the imaging member 12.

Finally, the imaging member should be cleaned of any residual ink. Most of this residue can be easily removed quickly using an air knife 77 with sufficient air flow. Removal of any remaining ink can be accomplished at cleaning subsystem 72.

In conventional offset printing, the fountain solution is deposited upon the imaging member and remains as a layer upon the surface of the imaging member. Again, due to the fluid nature of the release agent, the surface tension of the fluid tends to reshape the edges/corners of the non-image areas after the removal of the release agent. As a result, image resolution and image fidelity are reduced. The imaging members of the present disclosure differ in that the fountain solution (aka release agent) is absorbed by the imaging member instead of resting upon the surface of the imaging member. The edge acuity can be improved using the present imaging members, because movement of the edges of fountain solution is significantly reduced.

Figure 2:
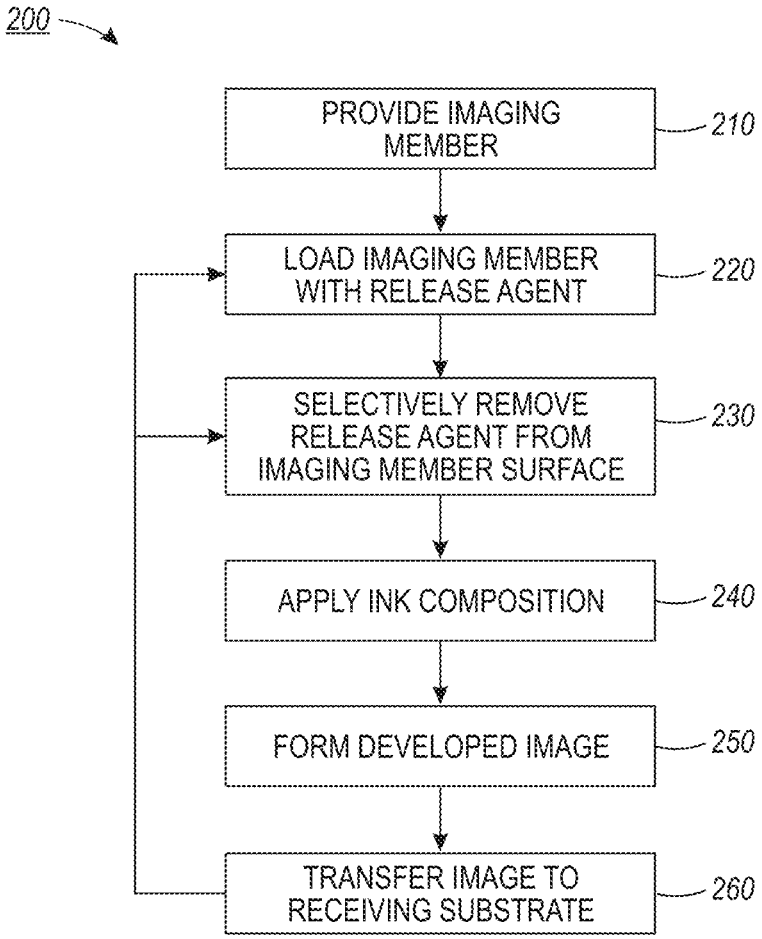
FIG. 2 illustrates an exemplary variable lithographic printing process of the present disclosure.

FIG. 2 is a flowchart that generally illustrates an exemplary variable lithographic printing process 200 of the present disclosure. An imaging member is provided 210. The imaging member is loaded with release agent 220, and the release agent is absorbed into the imaging member. Next, release agent is selectively removed from the imaging member surface 230, though it should be noted that the release agent is under the surface or within the imaging member, rather than upon the surface of the imaging member. Ink is applied upon the imaging member surface 240. The application of ink forms a developed image 250. The developed image is then transferred to a receiving substrate 260.

Figure 3:
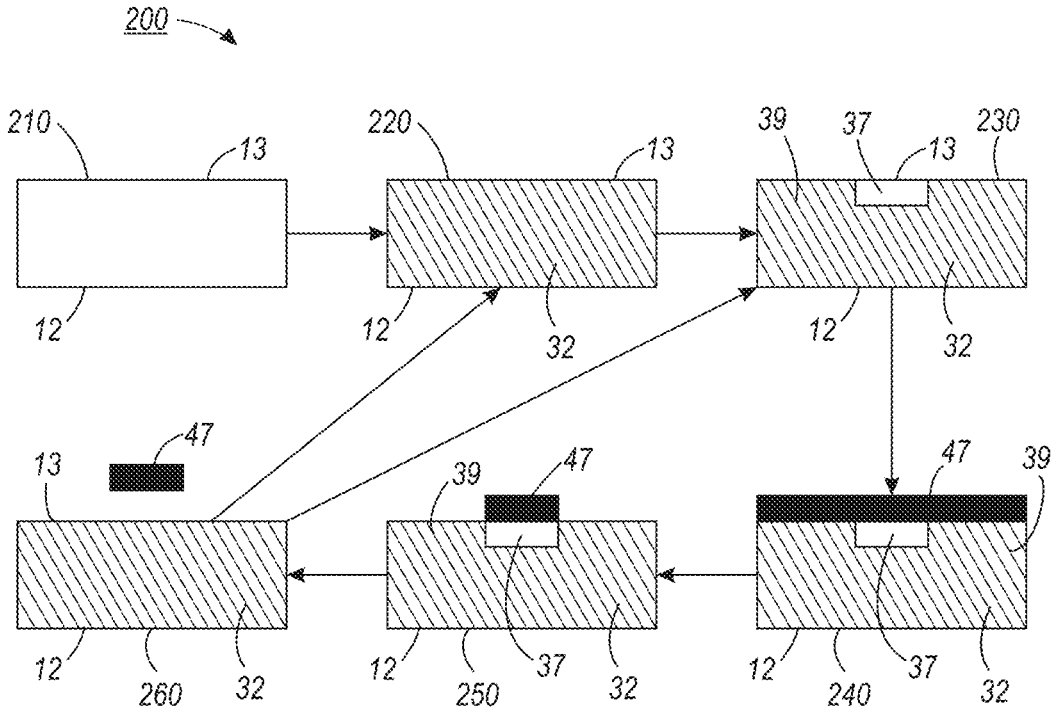
FIG. 3 is a graphical illustration of an imaging member used in the process depicted in FIG. 2.

FIG. 3 illustrates the various components of the apparatus and their interaction in the printing process. Initially, as seen in step 210, an imaging member 12 is provided. The imaging member 12 may generally have any suitable shape. In some embodiments, the imaging member is a flat plate. In other embodiments, the imaging member is cylindrical or a belt.

The imaging member comprises a surface layer and a substrate. Only the surface layer is shown in FIG. 3. The surface layer includes a surface 13 upon which ink will be deposited. The surface layer and substrate may be formed of the same or different materials. The surface layer is configured to be capable of absorbing a release agent. For example, the surface layer may be a foam or a sponge. The foam or sponge may comprise an elastomeric material and a radiation-absorbing filler. In some embodiments, the filler is carbon black.

In some embodiments, the elastomeric material from which the surface layer is formed may be a porous material which has voids/pores filled with air in the absence of release agent. The pore size (by diameter) can typically be around one micron or less for good image resolution. The imaging member can absorb the release agent through capillary action and release the fluid when subjected to pressure. It is desirable for the imaging member to be capable of absorbing more than 10 weight percent of the release agent.

In some other embodiments, the imaging member is a non-porous polymeric elastomer which absorbs the release agent through swelling. The molecules of the release agent are inherently able to penetrate the elastomer; they can overcome the cohesive forces between the elastomer molecules sufficiently to enable their separation from one another. If the specific release agent-elastomer affinity is high, progressive and significant swelling of the polymeric elastomer by the release agent can occur. In the current application, two preferred polymeric elastomers are silicone rubbers and fluorosilicone rubbers. Silicone oils are compatible with silicone rubbers, and they can form a good release agent-imaging member pair/set. Similarly, fluorosilicone oils and fluorosilicone rubbers also form a compatible material pair. However, for example, silicone rubbers and fluorosilicone oils are generally not compatible with each other.

The term "silicone" is well understood in the arts and refers to polyorganosiloxanes having a backbone formed from silicon and oxygen atoms and sidechains containing carbon and hydrogen atoms. For the purposes of this application, the term "silicone" should also be understood to exclude siloxanes that contain fluorine atoms, while the term "fluorosilicone" is used to cover the class of siloxanes that contain fluorine atoms. Other atoms may be present in the silicone rubber, for example nitrogen atoms in amine groups which are used to link siloxane chains together during crosslinking. The sidechains of the polyorganosiloxane can also be alkyl or aryl.

The term "alkyl" as used herein refers to a radical which is composed entirely of carbon atoms and hydrogen atoms which is fully saturated. The alkyl radical may be linear, branched, or cyclic. Linear alkyl radicals generally have the formula $—C_nH_{2n+1}$.

The term "aryl" refers to an aromatic radical composed entirely of carbon atoms and hydrogen atoms. When aryl is described in connection with a numerical range of carbon atoms, it should not be construed as including substituted aromatic radicals. For example, the phrase "aryl containing from 6 to 10 carbon atoms" should be construed as referring to a phenyl group (6 carbon atoms) or a naphthyl group (10 carbon atoms) only, and should not be construed as including a methylphenyl group (7 carbon atoms).

Desirably, the silicone rubber is flow coatable, which permits easy manufacturing of the surface layer. In addition, the silicone rubber may be room temperature vulcanizable, or in other words uses a platinum catalyst for curing. In particular embodiments, the silicone rubber is a poly(dimethyl siloxane) containing functional groups that permit addition crosslinking.

Next at step 220 in FIG. 3, the imaging member 12 is loaded with a release agent 32. If the imaging member is made of silicone rubber, the release agent may be a volatile silicone oil. In some such embodiments, the volatile silicone oil is octamethylcyclotetrasiloxane (D4), decamethylcyclopentasiloxane (D5), hexamethyldisiloxane (OS10), or octamethyltrisiloxane.

After loading, an absorbed portion of the release agent is present within the imaging member while a surface portion of the release agent is distributed at the surface 13 of the imaging member. Again, the release agent is generally absorbed within the imaging member instead of being entirely located upon the surface of the imaging member. A small quantity of the applied release agent may be present upon the surface, but the processes of the present disclosure generally contemplate that the release agent is contained wholly within the imaging member, i.e. below the surface of the imaging member.

Then at step 230 in FIG. 3, a latent image is formed by selectively evaporating the release agent at the surface 13 of the imaging member to form non-image areas and image areas. This is illustrated here by image area 37, where the release agent has been evaporated. Release agent 32 is still present in other areas at the surface of the imaging member to form non-image areas 39. In some embodiments, the selective evaporation is performed or aided via laser, flash, or contact heating.

In step 240 of FIG. 3, an ink composition 47 is applied to the imaging member surface. The ink composition selectively wets the image areas 37, which are free of release agent. In other words, a developed image is formed on the portions of the imaging member surface where the release agent 32 was evaporated. The ink composition has low adhesion to the imaging surface due to the presence of the release agent, and thus will not stick to the surface of the imaging member. Step 240 shows the ink composition being applied to both image areas 37 and non-image areas 39. Step 250 shows the imaging member post-inking. Because the ink was incompatible with non-image areas 39, the ink did not remain. Ink 47 is present only upon image area 37.

If desired, the developed image may be partially cured to optimize its cohesion, i.e. tacking, for transfer.

Finally in step 260 of FIG. 3, the developed image is then transferred to a receiving substrate. Although release agent was evaporated to form image area 37, the remaining absorbed release agent in the imaging member will diffuse or migrate through to "fill up" image area 37. However, this is desirable in the transfer step 260. Because the ink composition 47 and release agent 32 are immiscible, the diffusing release agent may be considered as filling in the image area and repelling the ink composition from the surface 13 of the imaging member. This increases the amount of ink 47 transferred from the imaging member 12 to the receiving substrate and/or the rate at which the ink 47 is transferred. The transferred image on the surface of the receiving substrate may then be cured (not shown).

At this point, the imaging member can start the imaging cycle again. The spent imaging member can be refreshed with release agent after transferring the image to the receiving substrate. In other words, the imaging member can move from step 260 to step 220.

In other embodiments, the imaging member includes enough remaining release agent to be used for multiple cycles prior to reloading. In such these embodiments, steps 210 and 220 are not performed. Rather, a plurality of cycles of steps 230, 240, 250, and 260 may be performed prior to reloading step 220. The number of cycles may be from 2 to about 100, including from about 2 to about 10. It is contemplated that the release agent diffuses through the imaging member surface to "erase" the device by homogenizing the release agent concentration on the surface and within the imaging member to eliminate any potential ghosting effect from previous cycles.

Because the release agent is absorbed inside a non-flammable solid imaging member, release agents having lower boiling and/or flash points can be utilized with the processes of the present disclosure. These release agents permit less energy to be used by the laser for evaporation.

The level of free fluid upon the imaging member surface throughout the processes of the present disclosure may be reduced compared to other methods. Accordingly, image degradation due to hydrodynamic flow of fluid at the nip may be greatly reduced. Additionally, the pull-back effect may be reduced. Furthermore, a more aggressive vacuum can be used during imaging to prevent vapor redeposition.

The release agent may be a volatile silicone liquid. In some embodiments, the volatile silicone liquid is a linear siloxane having the structure of Formula (II):

Formula (II)

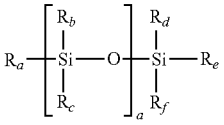

wherein $R_a$, $R_b$, $R_c$, $R_d$, $R_e$, and $R_f$ are each independently hydrogen, alkyl, fluoroalkyl, or perfluoroalkyl; and a is an integer from 1 to about 5. In some specific embodiments, $R_a$, $R_b$, $R_c$, $R_d$, $R_e$, and $R_f$ are all alkyl. In more specific embodiments, they are all alkyl of the same length (i.e. same number of carbon atoms).

In this regard, the term "fluoroalkyl" as used herein refers to a radical which is composed entirely of carbon atoms and hydrogen atoms, in which one or more hydrogen atoms may be (i.e. are not necessarily) substituted with a fluorine atom, and which is fully saturated. The fluoroalkyl radical may be linear, branched, or cyclic. It should be noted that an alkyl group is a subset of fluoroalkyl groups.

The term "perfluoroalkyl" as used herein refers to a radical which is composed entirely of carbon atoms and fluorine atoms which is fully saturated and of the formula $—C_nF_{2n+1}$. The perfluoroalkyl radical may be linear, branched, or cyclic. It should be noted that a perfluoroalkyl group is a subset of fluoroalkyl groups, and cannot be considered an alkyl group.

Exemplary compounds of Formula (II) include hexamethyldisiloxane and octamethyltrisiloxane, which are illustrated below as Formulas (II-a) and (II-b):

Formula (II-a)

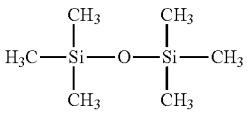

-continued

Formula (II-b)

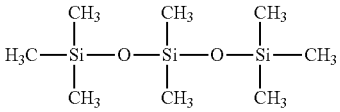

In other embodiments, the volatile silicone liquid is a cyclosiloxane having the structure of Formula (III):

Formula (III)

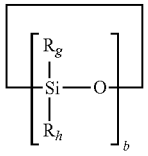

wherein each $R_g$ and $R_h$ is independently hydrogen, alkyl, fluoroalkyl, or perfluoroalkyl; and b is an integer from 3 to about 8. In some specific embodiments, all of the $R_g$ and $R_h$ groups are alkyl. In more specific embodiments, they are all alkyl of the same length (i.e. same number of carbon atoms).

Exemplary compounds of Formula (III) include octamethylcyclotetrasiloxane (aka D4) and decamethylcyclopentasiloxane (aka D5), which are illustrated below as Formulas (III-a) and (III-b):

Formula (III-a)

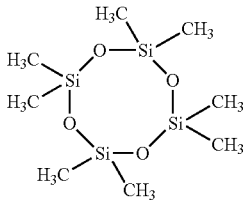

Formula (III-b)

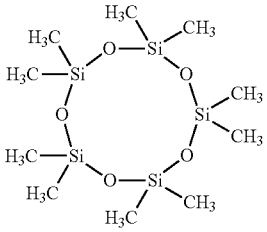

In other embodiments, the volatile silicone liquid is a branched siloxane having the structure of Formula (IV):

Formula (IV)

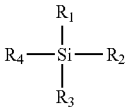

wherein $R_1$, $R_2$, $R_3$, and $R_4$ are independently alkyl or $—OSiR_1R_2R_3$.

An exemplary compound of Formula (IV) is methyl trimethicone, also known as methyltris(trimethylsiloxy)silane, which is commercially available as TMF-1.5 from Shin-Etsu, and shown below with the structure of Formula (IV-a):

Formula (IV-a)

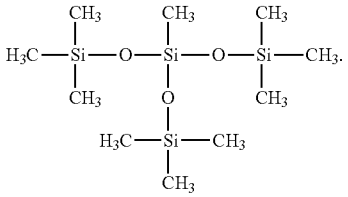

Any of the above described hydrofluoroethers/perfluorinated compounds are miscible with each other. Any of the above described silicones are also miscible with each other. This allows for the tuning of the dampening fluid for optimal print performance or other characteristics, such as boiling point or flammability temperature. Combinations of these hydrofluoroether and silicone liquids are specifically contemplated as being within the scope of the present disclosure. It should also be noted that the silicones of Formulas (II), (III), and (IV) are not considered to be polymers, but rather discrete compounds whose exact formula can be known.

In particular embodiments, it is contemplated that the dampening fluid comprises a mixture of octamethylcyclotetrasiloxane (D4) and decamethylcyclopentasiloxane (D5). Most silicones are derived from D4 and D5, which are produced by the hydrolysis of the chlorosilanes produced in the Rochow process. The ratio of D4 to D5 that is distilled from the hydrolysate reaction is generally about 85% D4 to 15% D5 by weight, and this combination is an azeotrope.

In particular embodiments, it is contemplated that the dampening fluid comprises a mixture of octamethylcyclotetrasiloxane (D4) and hexamethylcyclotrisiloxane (D3), the D3 being present in an amount of up to 30% by total weight of the D3 and the D4. The effect of this mixture is to lower the effective boiling point for a thin layer of dampening fluid.

These silicone liquids typically do not contain any fluorine atoms when the silicone rubber is used in the imaging member surface layer. When a fluorosilicone rubber is used in the imaging surface layer, the silicone liquids typically contain fluoroalkyl or perfluoroalkyl sidechains. An exemplary fluorinated silicone liquid is 1,3,5-tris[(3,3,3-trifluoropropyl) methyl]cyclotrisiloxane (D3F).

These volatile hydrofluoroether liquids and volatile silicone liquids have a low heat of vaporization, low surface tension, and good kinematic viscosity.

The ink compositions contemplated for use with the present disclosure generally include a colorant and a plurality of selected crosslinkable compounds. The crosslinkable compounds can be cured under ultraviolet (UV) light to fix the ink in place on the final receiving substrate. As used herein, the term "colorant" includes pigments, dyes, quantum dots, mixtures thereof, and the like. Dyes and pigments have specific advantages. Dyes have good solubility and dispersibility within the ink vehicle. Pigments have excellent thermal and light-fast performance. The colorant is present in the ink composition in any desired amount, and is typically present in an amount of from about 10 to about 40 weight percent (wt %), based on the total weight of the ink composition, or from about 20 to about 30 wt %. Various pigments and dyes are known in the art, and are commercially available from suppliers such as Clariant, BASF, and Ciba, to name just a few.

The ink compositions may have a viscosity of from about 5,000 to about 40,000 centipoise at 25° C. and infinite shear, including a viscosity of from about 7,000 to about 15,000 cps. These ink compositions may also have a surface tension of at least about 25 dynes/cm at 25° C., including from about 25 dynes/cm to about 40 dynes/cm at 25° C. These ink compositions possess many desirable physical and chemical properties. They are compatible with the materials with which they will come into contact, such as the dampening fluid, the surface layer of the imaging member, and the final receiving substrate. They also have the requisite wetting and transfer properties. They can be UV-cured and fixed in place. They also have a good viscosity; conventional offset inks usually have a viscosity above 50,000 cps, which is too high to use with nozzle-based inkjet technology. In addition, one of the most difficult issues to overcome is the need for cleaning and waste handling between successive digital images to allow for digital imaging without ghosting of previous images. These inks are designed to enable very high transfer efficiency instead of ink splitting, thus overcoming many of the problems associated with cleaning and waste handling. The ink compositions of the present disclosure do not gel, whereas regular offset inks made by simple blending do gel and cannot be used due to phase separation.

Aspects of the present disclosure may be further understood by referring to the following examples. The examples are illustrative, and are not intended to be limiting embodiments thereof.

EXAMPLES

A silicone drum imaging member was provided by blending a regular silicone (from Toray) with 10% carbon black and then curing. The imaging member was loaded with a release agent (D4) through roll coating. The imaging member was selectively heated to remove the release agent from an image area surface by laser heating or contact heating. A latent image was formed on the image area surface. Ink was provided to the imaging member by hand rolling at a speed greater than 1 meter per second to develop the latent image. The ink used in this example was TOYO Aqualess UV ink. The developed image was transferred to a paper receiving substrate.

Figure 4:
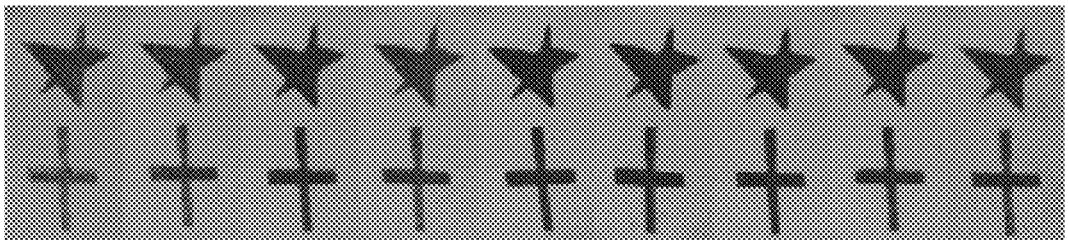
FIG. 4 includes 9 pictures of images formed on receiving substrates in accordance with an exemplary embodiment of the present disclosure.

After the initial cycle, the selective heating through transferring steps were performed 8 more times without reloading the imaging member with release agent. The results are illustrated in FIG. 4 wherein the leftmost image is a picture of the receiving substrate from the initial cycle and the rightmost image is a picture of the receiving substrate from the last cycle.

The present disclosure has been described with reference to exemplary embodiments. Obviously, modifications and alterations will occur to others upon reading and understanding the preceding detailed description. It is intended that the present disclosure be construed as including all such modifications and alterations insofar as they come within the scope of the appended claims or the equivalents thereof.

What is claimed is:

1. A process for variable lithographic printing, comprising:

absorbing a release agent into an imaging member comprising an imaging member surface, wherein the imaging member surface is porous;

forming a latent image by evaporating the release agent from selective locations at the imaging member surface to form hydrophobic non-image areas and hydrophilic image areas;

developing the latent image by applying an ink composition to the hydrophilic image areas to form a developed image; and transferring the developed image to a receiving substrate;

wherein the imaging member is a foam or a sponge.

2. The process of claim 1, wherein the absorbed release agent diffuses to the imaging member surface to enhance the transferring.

3. The process of claim 1, wherein the release agent is a volatile silicone liquid.

4. The process of claim 3, wherein the volatile silicone liquid is octamethylcyclotetrasiloxane (D4), decamethylcyclopentasiloxane (D5), hexamethyldisiloxane (OS10), or octamethyltrisiloxane (OS20).

5. The process of claim 1, wherein the evaporating is performed by laser heating, flash heating, or contact heating.

6. The process of claim 1, wherein the foam or sponge comprises an elastomeric material and a radiation-absorbing filler dispersed therein.

7. The process of claim 6, wherein the radiation absorbing filler is carbon black.

8. The process of claim 6, wherein the elastomeric material comprises a silicone rubber.

9. The process of claim 1, wherein the imaging member comprises an elastomeric material and a radiation-absorbing filler dispersed therein.

10. The process of claim 9, wherein the elastomeric material comprises a silicone rubber.

11. The process of claim 1, wherein the receiving substrate is moving at a rate of greater than about 1 meter per second when the latent image is transferred.

12. The process of claim 1, wherein the receiving substrate is moving at a rate of greater than about 2 meters per second when the latent image is transferred.

* * * * *